United States Patent [19]

Nishida et al.

[11] 4,354,802

[45] Oct. 19, 1982

[54] VANED DIFFUSER

[75] Inventors: Hideo Nishida; Fumio Koseki, both of Shimoinayoshi; Ichiro Gyobu, Dejimamura, all of Japan

[73] Assignee: Hitachi, Ltd., Tokyo, Japan

[21] Appl. No.: 136,488

[22] Filed: Apr. 3, 1980

[30] Foreign Application Priority Data

Apr. 6, 1979 [JP] Japan ..... 54-44726[U]

[51] Int. Cl.[3] ..... F04D 29/30

[52] U.S. Cl. ..... 415/207; 415/211

[58] Field of Search ..... 415/DIG. 1, 211, 207

[56] References Cited

U.S. PATENT DOCUMENTS

| | | | |
|---|---|---|---|
| 2,351,516 | 6/1944 | Jandasek | 415/DIG. 1 |
| 2,373,713 | 4/1945 | Shoults | 415/211 N |
| 2,406,499 | 8/1946 | Jandasek | 415/DIG. 1 |
| 3,039,736 | 6/1962 | Pon | 415/DIG. 1 |

FOREIGN PATENT DOCUMENTS

| | | | |
|---|---|---|---|
| 2135286 | 1/1973 | Fed. Rep. of Germany | 415/DIG. 1 |
| 971224 | 1/1951 | France | 415/211 |

*Primary Examiner*—Leonard E. Smith

*Attorney, Agent, or Firm*—Antonelli, Terry & Wands

[57] ABSTRACT

A vaned diffuser disposed around an outer periphery of an impeller of a centrifugal compressor comprises a pair of diffuser plates which constitute side walls of the vaned diffuser and define therebetween a fluid channel, and a plurality of vanes arranged in the fluid channel defined between the diffuser plates. At least one rib is arranged on that surface area of at least one of the diffuser plates which is defined between the adjacent vanes, so as to improve condition of a fluid flowing through the vaned diffuser to thereby improve efficiency of the latter. The rib is of a height not larger than one-half the height of the vanes and has a leading edge located upstream of the leading edges of the vanes as viewed in a fluid flow direction.

7 Claims, 7 Drawing Figures

VANED DIFFUSER

FIELD OF THE INVENTION

The present invention relates to a vaned diffuser for a fluid machine such as centrifugal or mixed flow fluid machine, and more particularly to a vaned diffuser of the type described which enables the efficiency of the fluid machine to be increased.

DESCRIPTION OF THE PRIOR ART (FIGS. 1-4)

Figure 1:
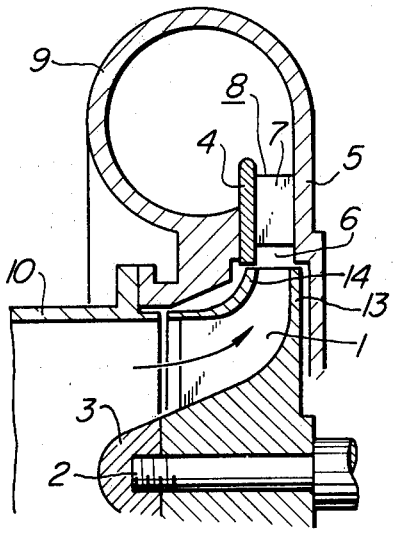
FIG. 1 PRIOR ART
FIG. 1 is a vertical sectional view of a centrifugal fluid machine of the prior art.

In a centrifugal compressor which is one of the centrifugal fluid machines, gas is compressed by the rotation of an impeller and the kinetic energy of the gas is changed to a pressure by means of a vaned diffuser arranged around an outer peripheral portion of the impeller. FIG. 1 shows a centrifugal compressor of the prior art wherein parts similar to those of a centrifugal compressor provided with the vaned diffuser according to the invention subsequently to be described are designated by like reference characters.

Figure 2:
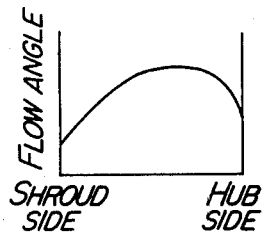
FIG. 2 is a schematic view showing the widthwise distribution of a flow angle at the outlet of the impeller.

In this type of compressor, a fluid is drawn by suction into the impeller 1 through a suction duct 10. In the impeller, a boundary layer develops on the surface of the fluid channel and the fluid flow is influenced by the Coriolis force and the curvature of the fluid channel, so that the fluid of low momentum is collected on the suction surface (posterior surface with respect to the direction of rotation) of each vane as viewed circumferentially and on the shroud side as viewed widthwise of each vane. As a result, a nonuniform flow distribution or flow distortion occurs at the outlet of the impeller (See FIG. 2). More specifically, in the vicinity of the wall surfaces, the flow angle (an angle formed by the fluid flow and the circumferential direction) is small and the fluid has low momentum. The flow distortion described hereinabove does not disappear and still remains in a vaneless diffuser 6 constituting the upstream portion of a vaned diffuser 8. When the flow distortion takes place on a large scale, separation of flow occurs near the wall surfaces of the vaneless diffuser 6 with the resultant increase in loss. Moreover, when the flow angle has a nonuniform widthwise distribution at the inlet of the vaned diffuser 8, it is possible to cause the flow angle to match the vane angle in a specific widthwise position but their mismatch occurs in other positions, whereby an increase in incidence loss occurs. The incidence loss is particularly great in the vicinity of the wall surfaces of the vane inlet of the vaned diffuser.

Figure 3:
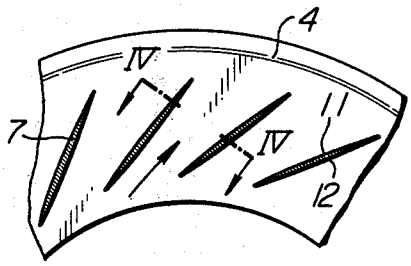
FIG. 3 PRIOR ART
FIG. 3 is a front view of a vaned diffuser of the prior art.
Figure 4:
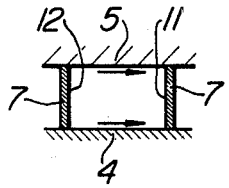
FIG. 4 PRIOR ART
FIG. 4 is a transverse sectional view of the vaned diffuser as seen in the direction of arrows IV—IV in FIG. 3.

Also, in the widthwise central portion of the vaned diffuser, the main flow flows along the vanes (See FIG. 3), however, a secondary flow (See FIG. 4) directed from a suction surface 12 of a vane 7 toward a pressure surface 11 of the adjacent vane 7 occurs in the boundary layer near the surfaces of the flow channel defined by diffuser plates 4 and 5. This secondary flow also causes a loss.

The loss in the vaneless diffuser 6, the incidence loss at the inlet of the vaned diffuser 8, and the loss due to the secondary flow in the vaned diffuser 8 described hereinabove disadvantageously deteriorate the performance of the centrifugal compressor.

Proposals have hitherto been made to provide ribs on the surfaces of diffuser plates for the purpose of improving the performance of a diffuser by avoiding the aforesaid phenomena, as disclosed, for example, in Japanese Patent Publication No. 6326/61 and Japanese Utility Model Publication No. 28119/71 (Registration No. 961072). However, these proposals are still insufficient for solving the aforesaid problems of the prior art.

SUMMARY OF THE INVENTION

It is an object of the present invention to provide a diffuser and a fluid machine of high efficiency and improved performance, which obviate the aforesaid disadvantages of the prior art fluid machine.

According to one of the features of the invention, a vaned diffuser for a fluid machine comprises rib means including at least one rib arranged on that surface area of at least one of the diffuser plates which is defined between the adjacent vanes, the rib being of a height not larger than one-half the height of the vanes and having a leading edge which is located upstream of the leading edges of the vanes as viewed in a fluid flow direction.

With the provision of the rib means of the aforesaid construction, a fluid of small flow angle near the wall surfaces of the vaneless diffuser is guided by and flows along the rib means without causing the fluid flow separation. Consequently, the loss in the vaneless diffuser is reduced. Further, since the flow angle increases as the fluid near the wall surfaces flows along the rib means toward the downstream side and the flow angle matches the vane angle at the inlet of the vaned diffuser, the incidence loss at the inlet of the vaned diffuser is significantly reduced. Furthermore, in the vaned diffuser, the secondary flow directed from the suction surface to the pressure surface of the vanes is prevented by the rib means. Thus, the loss caused by the secondary flow is also reduced. By reducing the losses as aforesaid, the performance of the fluid machine can be significantly improved.

DESCRIPTION OF THE PREFERRED EMBODIMENT (FIGS. 5-7)

Figure 5:
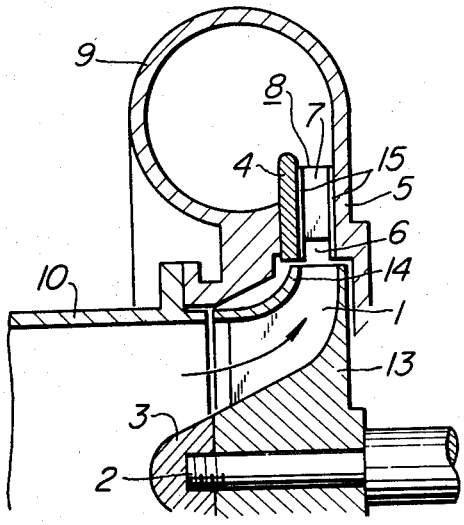
FIG. 5 is a vertical sectional view of a centrifugal fluid machine in accordance with an embodiment of the invention.
Figure 6:
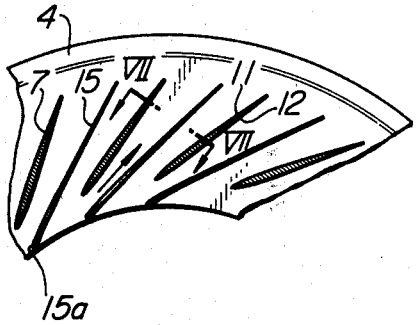
FIG. 6 is a front view of a vaned diffuser of the centrifugal fluid machine shown in FIG. 5.
Figure 7:
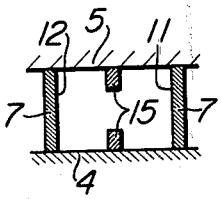
FIG. 7 is a transverse sectional view of the vaned diffuser as seen in the direction of arrows VII—VII in FIG. 6.

An embodiment of the invention will now be described by referring to FIGS. 5-7, wherein 1 designates an impeller, 2 a rotary shaft and 3 a nut for securing the impeller 1 to the rotary shaft 2. Disposed radially outwardly of the impeller 1 is a vaneless diffuser 6 including a fluid channel defined by a pair of diffuser plates 4 and 5, and a vaned diffuser 8 including a plurality of vanes 7 arranged in circular cascade between the diffuser plates 4 and 5. A casing 9 is located outwardly of the vaned diffuser 8. 10 designates a suction duct for introducing a fluid therethrough to a suction port of the impeller 1. 13 designates a hub of the impeller 1, and 14 a shroud thereof.

A plurality of ribs 15 are arranged in a fluid channel defined between the diffuser plates 4 and 5. More specifically, one rib 15 is arranged on that surface area of each diffuser plate which is located substantially at center point between one adjacent pair of the vanes 7. As will be understood from FIG. 7, the ribs 15 on the diffuser plate 4 and the corresponding ribs 15 on the diffuser plate 5 are in an opposed relationship with each other. Each rib 15 has a height not larger than one-half the height of each vane 7 of the vaned diffuser 8, and has a leading edge 15*a* which is located upstream of the leading edge of each vane 7 as viewed in a fluid flow direction. Each rib 15 has a configuration such that it is curved or warped in the same manner as the vanes 7 between the inlet and the outlet of each vane 7 and it has an inlet angle smaller than the inlet angle of each vane 7 in a portion of the rib extending upstream beyond the leading edge of each vane 7.

It is appropriate that, when the ribs 15 are arranged on only one diffuser plate 4 or 5 as described hereinafter, the ribs are designed to have a height not larger than ½ of the height of the vanes 7. When the ribs 15 are arranged on both of the diffuser plates, the ribs are designed to have a height not larger than ½ to, approximately, ¼ of the height of the vanes. In both cases, the ribs are designed to have a height not smaller than, approximately, 1/5 of the height of the vanes. Also it is to be noted that the portion of each rib positioned near the diffuser outlet may have a reduced height as compared with the portion thereof positioned near the diffuser inlet.

Because of the provision of the ribs 15 having the aforesaid construction, the flow of fluid from the impeller 1 is led to the inlet of the vaned diffuser 8 as being guided by the ribs 15. Thus, the separation of the flow of a low flow angle near the wall surfaces of the diffuser plates 4 and 5 is not caused, and the flow angle is altered to conform to the inlet angle of the vanes 7. This reduces the incidence loss at the inlet of the vanes 7. Also, in the fluid channel between the adjacent vanes 7, a secondary flow flowing along each diffuser plate from the suction surface 12 to the pressure surface 11 of the vanes 7 is blocked and reduced by virtue of the presence of the ribs 15, with the result that the pressure loss due to the formation of the secondary flow is reduced. Thus the efficiency of the diffuser can be increased.

In the illustrated embodiment, only one rib 15 is arranged on that surface area of each diffuser plate which is defined between one adjacent pair of the vanes 7. It is however to be understood that a plurality of ribs may be arranged on the same area. Also, it is possible to arrange the ribs on only one of the diffuser plates (on the diffuser plate 4 at the shroud side, for example), or to arrange the ribs to extend in the area of only the upstream portions of the vanes 7. Furthermore, it is to be understood that the invention is applicable to not only a centrifugal fluid machine as in the illustrated embodiment but also a mixed flow fluid machine.

What is claimed is:

1. A vaned diffuser for a turbocompressor comprising a pair of diffuser plates defining therebetween a fluid channel, and a plurality of vanes arranged in said fluid channel defined between said diffuser plates to form a circular cascade, the improvement comprising rib means including at least one rib arranged on at least one of said diffuser plates in a surface area defined between adjacent vanes, said at least one rib having a height not less than one fifth of a height of said vanes and a leading edge located upstream of leading edges of said vanes as viewed in a fluid flow direction, the at least one rib has a curved configuration corresponding to the vanes between an inlet and an outlet side of the vanes, and wherein an inlet angle of a leading edge of the rib is less than an inlet angle of the vanes.

2. A vaned diffuser as set forth in claim 1, wherein the rib extends upstream beyond the leading edge of the vanes to a position downstream of and in an immediate vicinity of an outlet of an impeller of the compressor.

3. A vaned diffuser for a turbocompressor comprising a pair of diffuser plates defining therebetween a fluid channel, and a plurality of vanes arranged in said fluid channel defined between said diffuser plates to form a circular cascade, the improvement comprising rib means including at least one rib arranged on at least one of said diffuser plates in a surface area defined between adjacent vanes, said at least one rib having a height of not less than one-fifth of a height of said vanes and a leading edge located upstream of leading edges of said vanes as viewed in a fluid flow direction, and wherein the at least one rib extends upstream beyond the leading edge of the vanes to a position downstream of and in an immediate vicinity of an outlet of an impeller of the compressor.

4. A vaned diffuser as set forth in claim 3, wherein said at least one rib has a height not larger than about one quarter of a height of the vanes.

5. A vaned diffuser as set forth in one of claims 1, 2 or 3, wherein said at least one rib is arranged on one of said diffuser plates located on a shroud side, and wherein said at least one rib is arranged on a surface area of said one diffuser plate at a position substantially at a center point between adjacent pairs of said vanes.

6. A vaned diffuser as set forth in one of claims 1, 2 or 3, wherein said rib means includes at least one first rib arranged on a surface area of one of said diffuser plates at a position located substantially at a center point between adjacent pairs of said vanes, and at least one second rib arranged on the other diffuser plate in an opposed position to said first rib.

7. A vaned diffuser as set forth in claim 6, wherein each of the ribs has a height not larger than about one-quarter of a height of the vanes.

* * * * *